US007198202B2

(12) United States Patent
Okada

(10) Patent No.: US 7,198,202 B2
(45) Date of Patent: Apr. 3, 2007

(54) DIFFERENTIAL EXPANSION ABSORPTION MECHANISM AND FUEL INJECTION VALVE COMPRISING SAME

(75) Inventor: Masaki Okada, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 3 days.

(21) Appl. No.: 11/104,747

(22) Filed: Apr. 13, 2005

(65) Prior Publication Data

US 2005/0236499 A1 Oct. 27, 2005

(30) Foreign Application Priority Data

Apr. 26, 2004 (JP) ..... 2004-129640
Apr. 27, 2004 (JP) ..... 2004-131338

(51) Int. Cl.
*F02M 47/02* (2006.01)

(52) U.S. Cl. ..... 239/88; 239/91; 239/96; 239/533.2; 239/533.3; 251/57; 123/467

(58) Field of Classification Search ..... 239/102.2, 239/88, 91, 96, 533.3, 533.4, 533.9; 251/57, 251/129.06; 123/446, 498; 310/326, 327, 310/346

See application file for complete search history.

(56) References Cited

U.S. PATENT DOCUMENTS 6,062,532 A * 5/2000 Gurich et al. ..... 251/57
6,062,533 A 5/2000 Kappel et al.
6,766,965 B2 * 7/2004 D'Arrigo ..... 239/102.2
2001/0035164 A1 11/2001 Rahardja et al.
2002/0179062 A1 12/2002 Shen et al.

FOREIGN PATENT DOCUMENTS

DE 43 06 072 A1 9/1994
DE 103 21 693 A1 12/2004
DE 103 32 088 A1 2/2005

(Continued)

OTHER PUBLICATIONS

Copy of Partial EPC Search Report for Serial No. EP 05 00 7671 dated Jul. 14, 2005.

(Continued)

*Primary Examiner*—Dinh Q. Nguyen
(74) *Attorney, Agent, or Firm*—McCormick, Paulding & Huber LLP

(57) ABSTRACT

The present invention provides a fuel injection valve which moves a needle valve (10) via a viscous fluid and a piston (7) by having an actuator (9) move a cylinder (3). The fuel injection valve comprises a sealing member (27) for sealing a gap between the cylinder (3) and piston (7), and a linking hole (29) formed in the piston (7) for connecting two chambers (5, 6) to each other. The size and/or shape of the linking hole (29) is set such that when a force for moving the cylinder (3) or piston (7) at a lower speed than the driving speed of the actuator (9) is generated due to differential thermal expansion between members, the viscous fluid moves between the two chambers (5, 6) through the linking hole (29), and when a force for moving the cylinder (3) at a higher speed than the force generated by the differential thermal expansion is generated by the actuator (9), the viscous fluid cannot pass through the linking hole (29).

7 Claims, 7 Drawing Sheets

FOREIGN PATENT DOCUMENTS

| | | |
|---|---|---|
| EP | 1 079 099 | 8/2000 |
| EP | 1 519 035 | 9/2004 |
| EP | 1 519 037 | 9/2004 |
| EP | 1 538 331 | 10/2004 |
| JP | 5-27277 | 9/1993 |
| JP | 08-261092 | 10/1996 |
| JP | 09-242615 | 9/1997 |
| JP | 09-310654 | 12/1997 |
| JP | 10-274127 | 10/1998 |
| JP | 2003-510508 | 3/2003 |
| JP | 2003-512555 | 4/2003 |

OTHER PUBLICATIONS

Copy of EPC Search Report for Serial No. EP 05 00 7671 dated Sep. 16, 2005.

* cited by examiner

DIFFERENTIAL EXPANSION ABSORPTION MECHANISM AND FUEL INJECTION VALVE COMPRISING SAME

CROSS REFERENCE TO RELATED APPLICATION

The applicant hereby claims foreign priority benefits under U.S.C. § 119 of Japanese Patent Applications No. 2004-129640 filed on Apr. 26, 2004 and Japanese Patent Application No. 2004-131338 filed on Apr. 27, 2004, and the content of which is herein incorporated by reference.

BACKGROUND OF THE INVENTION

1. Field of the Invention

The present invention relates to a differential expansion absorption mechanism for absorbing differential thermal expansion between members, and a fuel injection valve comprising same.

2. Description of the Related Art

Problems shared by mechanisms having comparatively elongated members (for example, an elongated actuator, rod, or the like) include physical deviations, malfunctions, and so on caused by differential thermal expansion between members. The reason for this is that when a member is elongated, differential thermal expansion (a difference in dimensional change caused by thermal expansion or thermal contraction) due to a temperature difference or a difference in the coefficient of thermal expansion (difference in material) between members increases.

Examples of a mechanism comprising an elongated member include a fuel injection valve mounted on a cylinder head or the like of an engine.

As shown in FIG. 7, for example, a fuel injection valve 100 for injecting a gaseous fuel, which is currently under development by the present inventor and so on, comprises a cylinder 102 accommodated movably (slidably) within a comparatively elongated barrel 101, a piston 105 accommodated movably (slidably) within the cylinder 102 so as to partition the interior of the cylinder 102 into an upper chamber 103 and a lower chamber 104, an incompressible viscous fluid (illustrated by dots) charged into the upper chamber 103 and lower chamber 104 respectively, an actuator 106 for raising the cylinder 102, and a needle valve 107 joined integrally to the piston 105. When the cylinder 102 is raised by the actuator 106, the needle valve 107 is lifted via the viscous fluid in the lower chamber 104 and the piston 105, thereby opening an injection hole 108 formed on the leading end (lower end) of the barrel 101.

The barrel 101 comprises a barrel main body 109, a tip 110 mounted on the lower end of the barrel main body 109 via a lock nut 119, and a cap 112 screwed onto the upper end of the barrel main body 109. The aforementioned fuel injection hole 108 is formed in the lower end of the tip 110, and a fuel inlet 111 is formed in the cap 112.

The cylinder 102 is supported and accommodated within the barrel main body 109 so as to be capable of sliding in a longitudinal direction (up/down direction). The cylinder 102 is constituted by a cylinder main body 117 in closed-end cylinder form, and a cylinder cap 118 which is screwed onto, and thus covers, the upper portion of the cylinder main body 117.

The piston 105 is accommodated within the cylinder 102 so as to be capable of sliding in the same direction (up/down direction) as the sliding direction of the cylinder 102 within the barrel 101, and the incompressible viscous fluid is charged into the upper chamber 103 and lower chamber 104 partitioned by the piston 105. The viscous fluid is charged through an injection passage not shown in the drawing such that the interior of the upper chamber 103 and lower chamber 104 is completely deaerated. The viscous fluid injection passage is blocked by a plug or the like after the viscous fluid has been injected.

The needle valve 107 is joined to the lower surface of the piston 105. The needle valve 107 extends downward through a through hole 128 provided in a bottom wall of the cylinder main body 117 such that the lower end thereof abuts against a seat portion 125 formed in the interior of the leading end of the barrel 101. The through hole 128 is provided with a sealing member 129 (an O-ring, for example) for sealing the gap between the through hole 128 and needle valve 107 in a fluid-tight fashion. Further, the fuel injection valve 100 is designed such that fuel supplied to the barrel 101 from the fuel inlet 111 provided in the upper end of the barrel 101 flows past each member into the seat portion 125.

A rod 120 is provided on the upper surface of the piston 105. The rod 120 is inserted slidably into a through hole 130 formed in the cylinder cap 118, and urged downward by a plate spring 123 via a pressing member (intermediate member) 122. The through hole 130 is provided with a sealing member 131 (an O-ring, for example) for sealing the gap between the through hole 130 and rod 120 in a fluid-tight fashion. By urging the needle valve 107 downward using the plate spring 123, the lower end portion of the needle valve 107 is seated on the seat portion 125 at a predetermined pressure, thereby closing the injection hole 108.

The actuator 106 is provided between the needle valve 107 and barrel main body 109. The actuator 106 comprises a magnetostrictor 113 disposed on the outside of the needle valve 107, and a coil 114 disposed on the outside of the magnetostrictor 113. The lower end of the magnetostrictor 113 abuts against a stepped surface portion 132 within the barrel main body 109 via a seat 115, and the upper end abuts against a lower surface of the cylinder main body 117 via a seat 116.

A plate spring 121 which urges the cylinder 102 downward to press the cylinder 102 against the magnetostrictor 113 via the seat 116 is disposed above the cylinder 102. The urging force of this plate spring 121 is greater than the urging force of the plate spring 123.

When the coil 114 of the actuator 106 is not energized via an external terminal 126 provided on the barrel 101, the needle valve 107 is urged downward by the plate spring 123, and hence the lower end portion of the needle valve 107 is pressed against the seat portion 125 of the tip 110 at a predetermined pressure such that the injection hole 108 is closed. Accordingly, fuel does not reach the injection hole 108, and fuel injection is not performed.

On the other hand, when the coil 114 is energized via the external-terminal 126, the coil 114 is magnetized, and the magnetostrictor 113 elongates in accordance with the magnetic force (magnetic field). At this time, the lower end of the magnetostrictor 113 is in contact with the stepped surface portion 132 of the barrel main body 109 via the seat 115, and hence the magnetostrictor 113 elongates in such a manner as to push the cylinder 102 upward against the urging force of the plate spring 121. When the cylinder 102 is pushed upward, the piston 105 and needle valve 107 are raised (lifted) integrally via the viscous fluid in the lower chamber 104. As a result, the lower end of the needle valve 107 separates from the seat portion 125 of the tip 110, thereby opening the fuel injection hole 108, and thus fuel injection is performed.

This type of fuel injection valve is also disclosed in Japanese Translation of International Patent Application Publication 2003-512555, for example.

With this type of fuel injection valve 100, the length (the dimension in the up/down direction) of the magnetostrictor 113 must be increased to a certain extent to secure the maximum lift amount required of the needle valve 107. As a result, the dimensions of the barrel 101, needle valve 107, and so on must be lengthened in alignment with the dimension of the magnetostrictor 113.

As described above, with a mechanism comprising an elongated member, differential thermal expansion between components (a difference in dimensional change due to thermal expansion or thermal contraction) is problematic. Particularly with the fuel injection valve 100, the lift amount of the needle valve 107, or in other words the amount of displacement of the actuator 106 (the elongation amount of the magnetostrictor 113) is comparatively small (several tens of μm, for example), and therefore even slight differential thermal expansion may affect operations.

Hence in the fuel injection valve 100 shown in FIG. 7, when differential thermal expansion occurs between members, measures are taken to enable the viscous fluid to move between the upper chamber 103 and lower chamber 104 through a small gap (clearance) between the inner surface of the cylinder 102 and the outer surface of the piston 105.

For example, when the thermal expansion of the magnetostrictor 113 is greater than the thermal expansion of the needle valve 107, a force which raises the cylinder 102 at a much lower speed than the driving speed of the actuator 106 (the elongation speed of the magnetostrictor 113 generated by change in the magnetic field) is produced, but at this time, the viscous fluid in the lower chamber 104 moves into the upper chamber 103 through the clearance between the cylinder 102 and piston 105. This causes the cylinder 102 to move upward relative to the piston 105 such that the differential thermal expansion between the needle valve 107 and magnetostrictor 113 is absorbed. As a result, the positions of the piston 105 and needle valve 107 become constant, and the operation is not affected.

Conversely, when the cylinder 102 is lifted upward by elongating the magnetostrictor 113 in order to perform fuel injection through the injection hole 108, the cylinder 102 is raised at a much higher speed than the aforementioned speed, and hence the pressure increase speed of the viscous fluid in the lower chamber 104 rises greatly beyond the pressure increase speed during the thermal expansion described above. At this time, the viscous fluid in the lower chamber 104 functions as a solid, and does not move to the upper chamber 103 through the clearance between the cylinder 102 and piston 105. Instead, the piston 105 and needle valve 107 are lifted integrally with the cylinder 102, and thus fuel injection is performed.

However, with the fuel injection valve 100, in which the viscous fluid is moved through the clearance between the cylinder 102 and piston 105 in the manner described above, a problem exists in that differences arise in the differential thermal expansion absorption performance of individual products (individual fuel injection valves).

The following points may be cited as reasons for this.

Reason 1: Differences in the clearance between the inner surface of the cylinder 102 and the outer surface of the piston 105 occur among individual products due to the difficulty involved in controlling and managing the clearance to a high degree of precision. Measures which may be taken to avoid this problem include increasing the finishing precision of the cylinder 102 and piston 105 or equalizing the clearance by measuring the dimensions of the cylinder 102 and piston 105 and selecting appropriate combinations thereof, but when such measures are implemented, adverse effects on productivity, such as cost increases and labor increases, are inevitable.

Reason 2: Variation in the cylindricity (circularity) of the inner surface of the cylinder 102 and the outer surface of the piston 105, variation (offset) in the concentricity of the cylinder 102 and piston 105, variation (tilting) between the central axis of the cylinder 102 and the central axis of the piston 105, and so on differ among individual products, and as a result, differences occur in the clearance of each product.

Reason 3: Dimensional change over time due to the sliding and so on of the cylinder 102 and piston 105 differs among individual products, and hence with use, differences in the clearance of individual products increase.

Reason 4: The viscosity of the viscous fluid changes due to wear particles produced by the sliding of the cylinder 102 and piston 105 entering the viscous fluid, and this change in viscosity differs among individual products. As a result, variation in the differential thermal expansion absorption performance occurs with use.

The fuel injection valve 100 described above also has the following problems.

In the fuel injection valve 100, the total volume of the upper chamber 103 and lower chamber 104 in the cylinder 102 is constant even when the piston 105 moves. Hence when the viscous fluid thermally expands to a greater extent than the cylinder 102, the pressure of the viscous fluid in the cylinder 102 increases, leading to such problems as disengagement or cracking of the sealing members 129, 131 such that the viscous fluid flows out of the upper chamber 103 and lower chamber 104, or disengagement of the plug which blocks the injection passage for injecting the viscous fluid such that the viscous fluid flows out therefrom.

To describe this point in further detail, in actuality, the change in the volume of the viscous fluid caused by thermal expansion thereof differs from the change in the total volume of the upper chamber 103 and lower chamber 104 caused by thermal expansion of the cylinder 102 by close to two orders of magnitude. Hence, for example, when the viscous fluid and cylinder 102 rise to a substantially equal temperature due to an increase in the overall temperature of the fuel injection valve 100 caused by heat from the cylinder head or the like, the thermal expansion of the viscous fluid is great, whereas the cylinder 102 does not thermally expand to a large extent. As a result the total volume of the upper chamber 103 and lower chamber 104 does not increase greatly, and therefore the basically incompressible viscous fluid tries to find an escape route out of the upper chamber 103 and lower chamber 104.

Here, the upper chamber 103 and lower chamber 104 are completely deaerated, and hence the internal pressure of the cylinder 102 increases, causing the expanded viscous fluid to break through, and flow out from, the comparatively weak sealing members 129, 131 for forming the upper chamber 103 and lower chamber 104 into airtight spaces, and/or the plug blocking the injection passage, and/or other possible fluid outlets. Note that the reason for completely deaerating the upper chamber 103 and lower chamber 104 is that if air bubbles existed within the upper chamber 103 and lower chamber 104, the air bubbles would be compressed upon elongation of the magnetostrictor 113 elongates in order to raise the cylinder 102. As a result the piston 105 would not rise integrally with the cylinder 102, leading to a delay or difficulty in lifting the needle valve 107.

To prevent such overflowing of the viscous fluid due to thermal expansion thereof, components having a substantially equal coefficient of thermal expansion may be used for the viscous fluid and cylinder 102. In reality, however, almost no such components exist. With the actual materials and substances used as the viscous fluid and cylinder 102, a differential thermal expansion of at least one order of magnitude exists between the viscous fluid and cylinder 102.

SUMMARY OF THE INVENTION

An object of the present invention is to provide a differential thermal expansion absorption mechanism in which differences in the differential thermal expansion absorption performance of individual products are small, and which is capable of reliably obtaining an appropriate differential thermal expansion absorption performance, and a fuel injection valve comprising same.

Another object of the present invention is to provide a differential thermal expansion absorption mechanism which is capable of preventing overflow of a viscous fluid from a chamber when the viscous fluid thermally expands, and a fuel injection valve comprising same.

A first aspect of the present invention is a differential expansion absorption mechanism having a cylinder accommodated movably inside a casing, a piston accommodated movably inside the cylinder for partitioning the interior of the cylinder into two chambers, a viscous fluid charged into the two chambers, an actuator for moving the piston through the viscous liquid by moving the cylinder, and an operating member connected to the piston. The differential expansion absorption mechanism absorbs differential thermal expansion between the casing, the actuator, the operating member, and so on, and comprises a sealing member for sealing a gap between the cylinder and piston, and a linking hole formed in the piston for connecting the two chambers to each other. The size and/or shape of the linking hole is set such that when a force for moving the cylinder or piston at a lower speed than the driving speed of the actuator is generated due to this differential thermal expansion, the viscous fluid moves between the two chambers through the linking hole such that the cylinder and the piston move relative to each other, thereby absorbing the differential thermal expansion, and when a force for moving the cylinder at a higher speed than the force generated by the differential thermal expansion is generated by the actuator, the viscous fluid cannot pass through the linking hole, and the piston moves integrally with the cylinder.

A second aspect of the present invention is a fuel injection valve having a cylinder accommodated movably inside a barrel, a piston accommodated movably inside the cylinder for dividing the interior of the cylinder into two chambers, a viscous fluid charged into the two chambers, an actuator for moving the cylinder, and a needle valve connected to the piston. The fuel injection valve moves the needle valve via the viscous fluid and piston by having the actuator move the cylinder, and comprises a sealing member for sealing a gap between the cylinder and piston, and a linking hole formed in the piston for connecting the two chambers to each other. The size and/or shape of the linking hole is set such that when a force for moving the cylinder or piston at a lower speed than the driving speed of the actuator is generated due to differential thermal expansion between the barrel, actuator, needle valve, and so on, the viscous fluid moves between the two chambers through the linking hole such that the cylinder and piston move relative to each other, thereby absorbing the differential thermal expansion, and when a force for moving the cylinder at a higher speed than the force generated by the differential thermal expansion is generated by the actuator, the viscous fluid cannot pass through the linking hole, and the piston and needle valve move integrally with the cylinder.

Here, the actuator may comprise a magnetostrictor or an electrostrictor.

Further, first urging means for pressing the cylinder and the actuator against each other, and second urging means for urging the needle valve in a valve closing direction may be provided.

A third aspect of the present invention is a differential expansion absorption mechanism having a cylinder accommodated slidably inside a casing, a piston for partitioning the interior of the cylinder into two chambers, and a viscous fluid charged into the two chambers respectively. The differential expansion absorption mechanism moves the piston through the viscous fluid by causing the cylinder to slide. An air chamber is connected via a throttle portion to at least one of the two chambers which risen in internal pressure when the cylinder or piston is caused to slide. The flow resistance of the throttle portion is set such that at a predetermined pressure increase speed or more, which is generated in the chamber when the cylinder or piston is caused to slide, the viscous fluid does not pass through the throttle portion, and at a lower pressure increase speed than this speed, which is generated in the chamber when the viscous fluid thermally expands, the expanded viscous fluid passes through the throttle portion.

A fourth aspect of the present invention is a fuel injection valve comprising a differential expansion absorption mechanism, having a cylinder accommodated slidably inside a barrel, a piston for partitioning the interior of the cylinder into two chambers, a viscous fluid charged into the two chambers respectively, an actuator for causing the cylinder to slide, and a needle valve connected to the piston. The fuel injection valve lifts the needle valve via the viscous fluid and piston by having the actuator cause the cylinder to glide. An air chamber is connected via a throttle portion to at least one of the two chambers which rises in internal pressure when the cylinder is caused to slide by the actuator. The flow resistance of the throttle portion is set such that at a pressure increase speed which is generated in the chamber when the cylinder is caused to slide by the actuator, the viscous fluid does not pass through the throttle portion, and at a lower pressure increase speed than this speed, which is generated in the chamber when the viscous fluid thermally expands, the expanded viscous fluid passes through the throttle portion.

Here, the actuator may cause the cylinder to slide upward, the piston may partition the interior of the cylinder vertically into an upper chamber and a lower chamber, the air chamber may be disposed above the upper chamber, and the throttle portion may be constituted by a first throttle portion linking the lower chamber and upper chamber, and a second throttle portion linking the upper chamber and air chamber. The flow resistance of the first throttle portion may be set such that at a pressure increase speed which is generated in the lower chamber when the cylinder is caused to slide by the actuator, the viscous fluid does not pass through the first throttle portion, and at a lower pressure increase speed than this speed, which is generated in each chamber when the viscous fluid thermally expands, the expanded viscous fluid passes through the first throttle portion.

Further, the flow resistance of the first throttle portion may be set lower than the flow resistance of the second throttle portion.

Further, the throttle portions and the air chamber may be provided in the interior of the cylinder and/or the piston.

Further, the actuator may comprise a magnetostrictor or an electrostrictor.

Further, first urging means for urging the cylinder in a direction in which the cylinder is pressed against the actuator, and second urging means for urging the needle valve in a valve closing direction may be provided.

DESCRIPTION OF THE PREFERRED EMBODIMENTS

A preferred embodiment of the present invention will now be described in detail on the basis of the attached drawings.

In this embodiment, the differential expansion absorption mechanism of the present invention is applied to a fuel injection valve for injecting a gaseous fuel such as compressed natural gas (CNG), propane gas, or hydrogen into a combustion chamber of an engine.

Figure 1:
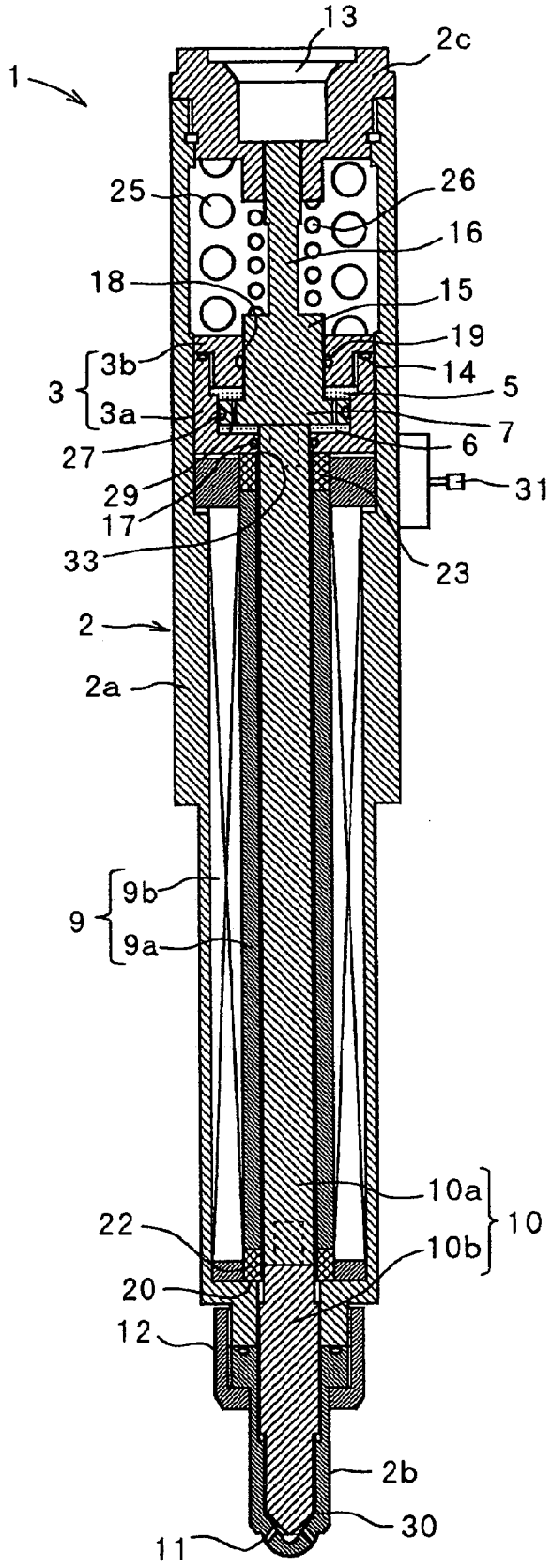
FIG. 1 is a sectional view of a fuel injection valve comprising a differential expansion absorption mechanism according to an embodiment of the present invention.
Figure 2:
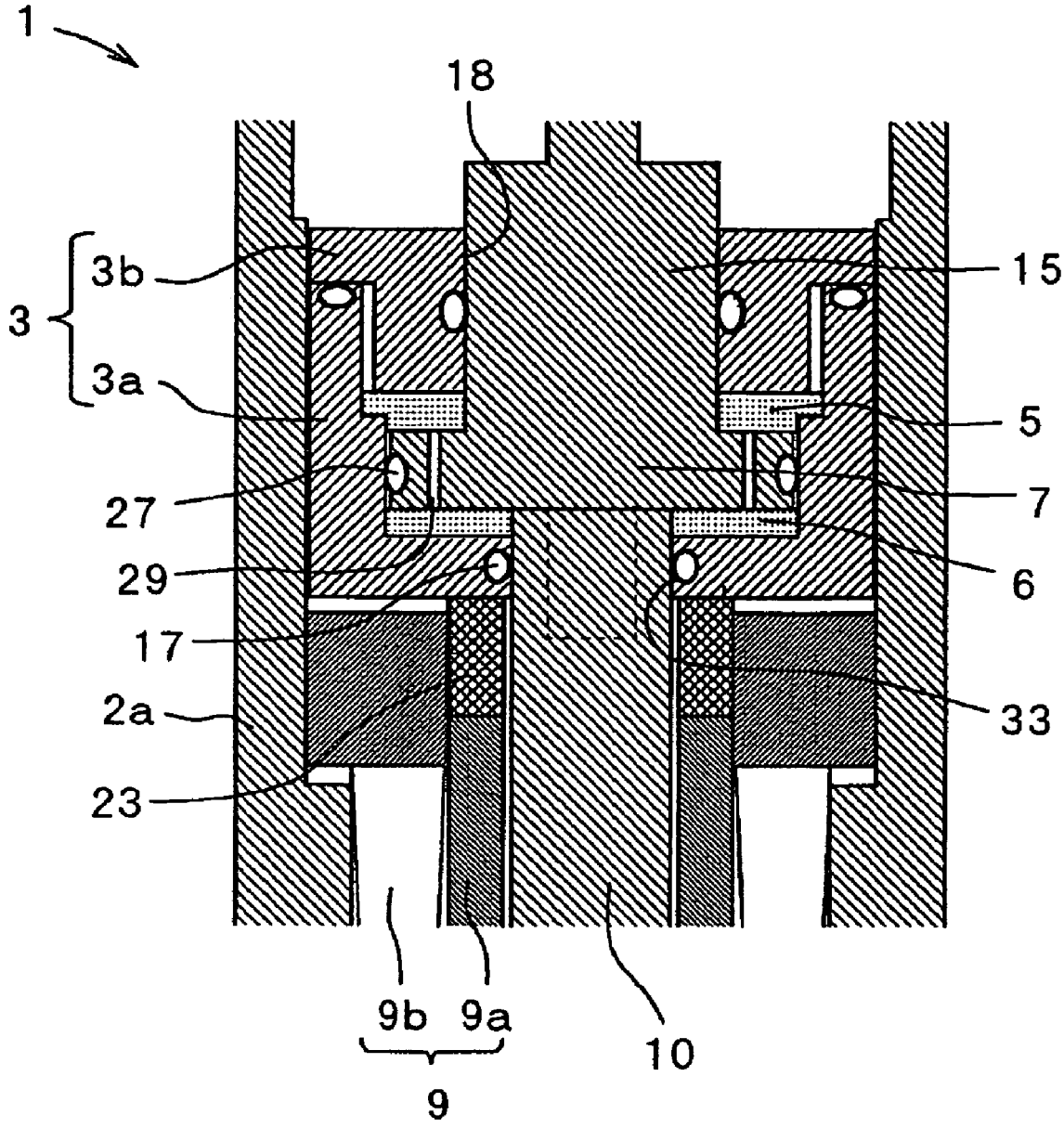
FIG. 2 is a partially enlarged sectional view of FIG. 1.

FIG. 1 is a sectional view of the fuel injection valve comprising the differential expansion absorption mechanism of this embodiment, and FIG. 2 is a partially enlarged view of FIG. 1.

As shown in FIG. 1, a fuel injection valve 1 of this embodiment comprises a cylinder (chamber) 3 accommodated movably (slidably) within a comparatively elongated barrel (casing) 2, a piston 7 accommodated movably within the cylinder 3, which partitions the interior of the cylinder 3 into an upper chamber 5 and a lower chamber 6, an incompressible viscous fluid charged into the upper chamber 5 and lower chamber 6, an actuator 9 for raising (moving) the cylinder 3, and a needle valve 10 connected to the piston 7. When the actuator 9 raises the cylinder 3, the needle valve 10 is raised (lifted) via the viscous fluid in the lower chamber 6 and the piston 7, thereby opening an injection hole (orifice) 11 formed in the leading end (lower end) of the barrel 2 such that fuel is injected therefrom.

The barrel 2 is disposed substantially vertically in a cylinder head, not shown, of the engine, and comprises a barrel main body 2*a*, a tip 2*b*attached integrally to the lower end of the barrel main body 2*a* via a lock nut 12, and a cap 2*c* screwed onto the upper end of the barrel main body 2*a*. A plurality of the injection holes 11 is formed radially in the lower end of the tip 2*b*, and a fuel inlet 13 for introducing fuel into the barrel main body 2*a* is formed in the cap 2*c*.

The cylinder 3 is supported within the barrel main body 2*a* so as to be capable of sliding in a longitudinal direction (up/down direction). The cylinder 3 is constituted by a closed-end cylinder form cylinder main body 3*a*, and a cylinder cap 3*b* screwed onto the upper end of the cylinder main body 3*a*. The cylinder main body 3*a* and cylinder cap 3*b* are sealed together by a sealing member 14 (an O-ring here).

The piston 7 is accommodated within the cylinder 3 so as to be capable of sliding in the same direction (up/down direction) as the sliding direction of the cylinder 3. The space in the interior of the cylinder 3 is divided into the upper chamber 5 and lower chamber 6 by the piston 7. The incompressible viscous fluid (silicone oil, for example) is charged into the upper chamber 5 and lower chamber 6.

The needle valve 10 is connected to the lower end of the piston 7, and is constituted by a rod 10*a* extending downward through a through hole 33 formed on the bottom wall of the cylinder main body 3*a*, and a needle 10*b* attached integrally to the lower end of the rod 10*a*. The lower end portion of the needle 10*b* abuts against a seat portion 30 formed in the tip 2*b*. A sealing member 17 (an O-ring here) for sealing the through hole 33 and rod 10*a* in a fluid-tight fashion is provided in the through hole 33.

A large-diameter rod 15 extending upward through a through hole 18 formed in the cylinder cap 3*b* and a small-diameter rod 16 protruding upward from the upper end of the large-diameter rod 15 are formed integrally on the upper end of the piston 7. A sealing member 19 (an O-ring here) for sealing the through hole 18 and large-diameter rod 15 in a fluid-tight fashion is provided in the through hole 18.

The actuator 9 is provided between the needle valve 10 and barrel main body 2*a*. The actuator 9 comprises a magnetostrictor 9*a* disposed on the periphery of the rod 10*a* of the needle valve 10 at a predetermined remove from the rod 10*a*, and a coil 9*b* disposed on the periphery of the magnetostrictor 9*a* at a predetermined remove from the magnetostrictor 9*a*. The lower end of the magnetostrictor 9*a* abuts against a stepped surface portion 20 within the barrel main body 2*a* via a seat 22, and the upper end abuts against the lower surface of the cylinder 3 via a seat 23.

A first urging member 25 (a coil spring here) for urging the cylinder 3 downward to press against the seat 23 and magnetostrictor 9*a*, and a second urging member 26 (a coil spring here) for urging the needle valve 10 downward (in a valve dosing direction) via the large-diameter rod 15 and piston 7, are provided between the upper surface of the cylinder 3 and the cap 2*c*. These springs 25, 26 are provided so as to be compressed by the cap 2*c* at a predetermined load. Note that the urging force of the spring 25 is greater than the urging force of the spring 26.

Features of the fuel injection valve 1 of this embodiment will now be described using FIG. 2.

As shown in FIG. 2, the fuel injection valve 1 of this embodiment comprises a sealing member 27 for completely sealing the gap between the inner surface of the cylinder 3 (cylinder main body 3*a*) and the outer surface of the piston 7. In other words, in the fuel injection valve 1, the viscous fluid is completely prohibited from moving between the upper chamber 5 and lower chamber 6 through a clearance between the cylinder 3 and piston 7. Any member which allows relative movement between the cylinder 3 and piston 7 while sealing the gap between the cylinder 3 and piston 7 may be used as the sealing member 27. For example, a rubber O-ring, packing, a metal seal, a diaphragm/bellows seal, or another seal may be used.

The fuel injection valve 1 further comprises a linking hole 29 formed through the piston 7 in an up/down direction for linking the upper chamber 5 and lower chamber 6. In this embodiment, two linking holes 29 are provided with a gap of 180° in the circumferential direction of the piston 7 therebetween. Thus, instead of blocking (sealing) the clearance between the cylinder 3 and piston 7 completely, a separate viscous fluid movement passage (the linking holes 29) is formed in the piston 7. Note that the number of linking holes 29 is not limited to two, and one, three, or more may be formed.

The size and/or shape of the linking holes 29 is set such that when a force which moves the cylinder 3 or piston 7 at a lower speed than the driving speed of the actuator 9 (the elongation speed of the magnetostrictor 9*a* caused by variation in the magnetic field) is generated due to differential thermal expansion (a difference in dimensional change produced by thermal expansion or thermal contraction) occurring as a result of a temperature difference or thermal expansion coefficient difference (material difference) between members such as the barrel 2, actuator 9 (in particular the magnetostrictor 9*a*), and needle valve 10, the viscous fluid is able to move between the upper chamber 5 and lower chamber 6 through the linking holes 29, and such that when a force which moves the cylinder 3 at a higher speed than the force produced by the aforementioned differential thermal expansion is generated by the actuator 9, the viscous fluid is unable to pass through the linking holes 29. The size, shape, number, and so on of the linking holes 29 are set appropriately on the basis of the driving characteristics (driving speed etc.) of the actuator 9, the characteristics of the viscous fluid (viscosity etc.), and so on.

Next, using FIGS. 1 and 2, an operation of the fuel injection valve 1 of this embodiment will be described.

The fuel introduced into the barrel main body 2*a* through the fuel inlet 13 in the cap 2*c* flows into the seat portion 30 of the tip 2*b* through a gap between the small-diameter rod 16 and cap 2*c*, a gap between the cylinder 3 and barrel main body 2*a*, a gap between the needle valve 10 and magnetostrictor 9*a*, a gap between the needle valve 10 and tip 2*b*, and so on. The pressure of this supplied fuel is set at approximately 100 to 250 Bar, for example.

When the coil 9*b* of the actuator 9 is not energized, the needle valve 10 is urged downward by the spring 26, and hence the lower end portion of the needle valve 10 is pressed against the seat portion 30 of the tip 2*b* with a predetermined pressure such that the injection holes 11 are closed. Accordingly, the fuel does not reach the injection holes 11, and fuel injection is not performed.

On the other hand, when power controlled to a desired value by a controller (ECU or the like) not shown in the drawing is supplied to the coil 9*b* via an external terminal 31, the coil 9*b* generates a magnetic field of an intensity corresponding to the supplied power.

When the coil 9*b* is magnetized, the magnetostrictor 9*a* elongates in the up/down direction by a length corresponding to the magnetic field intensity. At this time, the lower end of the magnetostrictor 9*a* is in contact with the stepped surface portion 20 of the barrel main body 2*a* via the seat 22, and hence the magnetostrictor 9*a* elongates in such a manner that the cylinder 3 is pushed upward against the urging force of the spring 25. The elongation speed of the magnetostrictor 9*a*, or in other words the speed at which the actuator 9 drives the cylinder 3, is comparatively high (for example, approximately several μm/μs). As described above, the size and/or shape of the linking holes 29 is set such that when the cylinder 3 is driven by the actuator 9, the viscous fluid cannot flow into the linking holes 29, and therefore when the magnetostrictor 9*a* raises the cylinder 3, the incompressible viscous fluid acts as a solid. Hence when the cylinder 3 is pushed upward by the magnetostrictor 9*a*, the piston 7 and needle valve 10 are raised up (lifted) integrally via the viscous fluid in the lower chamber 6, and the spring 26 is deformed. As a result, the lower end of the needle valve 10 separates from the seat portion 30 of the tip 2*b* such that the injection holes 11 are opened, whereupon the high-pressure fuel supplied up to the seat portion 30 is injected outside (into the combustion chamber) from the injection holes 11 as a spray.

Incidentally, when a temperature difference occurs between members due to heat generation in the coil 9*b*, heat in the combustion chamber that is transmitted through the tip 2*b*, and so on, or when differential thermal expansion occurs between members due to differences between members in their coefficients of thermal expansion and the like, a force which moves the cylinder 3 or piston 7 against the urging force of the springs 25, 26 at a much lower speed (for example, approximately several μm/min) than the driving speed of the actuator 9 may be generated.

For example, when the thermal expansion of the magnetostrictor 9*a* is greater than the thermal expansion of the needle valve 10, a force which moves the cylinder 3 upward at an extremely low speed is generated. At this time, when the internal pressure of the lower chamber 6 rises, the viscous fluid in the lower chamber 6 moves to the upper chamber 5 side through the linking holes 29. As described above, the reason for this is that the size and/or shape of the linking holes 29 is set such that when a slow driving force is generated by differential thermal expansion between members, the viscous fluid flows into the linking holes 29. As a result, the cylinder 3 moves upward relative to the piston 7, and the differential thermal expansion between the needle valve 10 and magnetostrictor 9*a* is absorbed by this relative movement. Hence the positions of the piston 7 and needle valve 10 become constant, and the operation is not adversely affected by erroneous fuel injection or the like. Note that since the gap between the cylinder 3 and piston 7 is sealed by the sealing member 27, the viscous fluid does not move therebetween.

Conversely, when the thermal expansion of the needle valve 10 is greater than the thermal expansion of the magnetostrictor 9*a*, a force which raises the piston 7 at an extremely low speed is generated. As a result, the viscous fluid inside the upper chamber 5 moves to the lower chamber 6 side through the linking holes 29. This causes the piston 7 to move upward relative to the cylinder 3 such that the differential thermal expansion between the needle valve 10 and magnetostrictor 9*a* is absorbed.

Thus in the fuel injection valve 1 of this embodiment, the viscous fluid moves through the linking holes 29 formed in the piston 7 when differential thermal expansion occurs between members, and hence the passage area of the viscous fluid (the sectional area of the linking holes 29) can be controlled and managed easily and precisely. As a result, differences between individual products (individual fuel injection valves) in their differential thermal expansion absorption performance can be reduced, and an appropriate differential thermal expansion absorption performance can be obtained reliably.

The reasons why differences between individual products in their differential thermal expansion absorption performance are reduced will now be described using specific numerical values.

Figure 7:
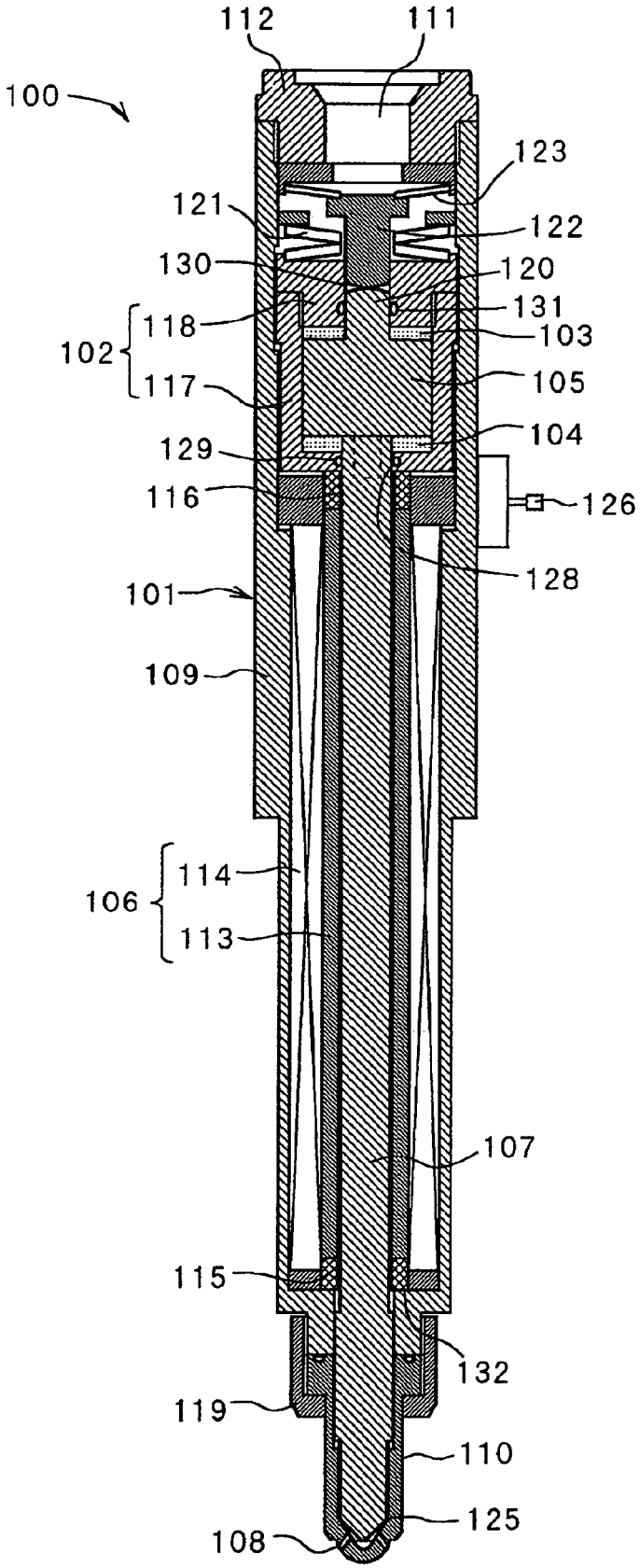
FIG. 7 is a sectional view showing a fuel injection valve developed in advance by the present inventor.

First, in the fuel injection valve 100 shown in FIG. 7, if a nominal (reference) diameter of the inner diameter of the cylinder 102 and the outer diameter of the piston 105 is set at ϕ16 mm, the finishing precision of the cylinder 102 is set at ϕ16 mm +10 to 20 μm (16.015 mm±5 μm), and the finishing precision of the piston 105 is set at ϕ16 mm−0 to −5 μm (15.9975 mm±2.5 μm), for example, the clearance between the two members in the diametrical direction is 17.5 μm±7.5 μm (10 to 25 μm). Here, when the total surface area of the clearance is calculated and converted into the surface area of a single hole, the diameter of the hole is ϕ0.566 mm at the minimum clearance (10 μm), and ±ϕ0.895 mm at the maximum clearance (25 μm). In other words, in the case of the linking holes 29 in the fuel injection valve 1 of this embodiment, a large manufacturing error of approximately 0.25 mm in diameter is produced. Naturally, this error is reduced if the finishing precision of the cylinder 102 and piston 105 is increased, but this leads to a large increase in the manufacturing cost, and moreover, there is an upper limit to precision.

On the other hand, in the fuel injection valve 1 of this embodiment, when the nominal diameter of the linking holes 29 is set at 0.5 mm, it is comparatively easy to perform finishing using a typical finishing device to a precision of 0.5 mm±0.05 mm, for example. In reality, the injection holes and so on of a fuel injection valve for a diesel engine are finished to a much higher precision. In this case, the manufacturing error of the linking holes 29 is 0.10 mm, which is less than half that of the fuel injection valve 100 described above. Thus with the fuel injection valve 1 of this embodiment, errors in the passage area of the viscous fluid can be reduced greatly below that of the fuel injection valve 100 shown in FIG. 7. The reason for this is that in the fuel injection valve 100, the dimensions of two members, i.e. the cylinder 102 and piston 105, must be managed, whereas in the fuel injection valve 1 of this embodiment, only the dimension of the linking holes 29 need be managed. As a result, differences among individual products in their differential thermal expansion absorption performance are reduced.

For reference, when the aforementioned error (0.5 mm±0.05 mm) in the linking holes 29 is converted to the clearance error of the fuel injection valve 100 shown in FIG. 7, the error becomes approximately 4 μm (±2 μm) when the nominal diameter of the cylinder 102 and piston 105 is ϕ16 mm, and thus from this point also it can be seen that the difference between individual products is reduced.

Further, with the fuel injection valve 1 of this embodiment, the sectional surface area (the viscous fluid passage area) of the linking holes 29 can be finished to a high degree of precision, and hence a passage area which is suited to the characteristics of the actuator 9 and viscous fluid can be obtained reliably. Hence the differential thermal expansion absorption performance can be obtained reliably and effectively. On the other hand, with the fuel injection valve 100 shown in FIG. 7, the manufacturing error of the clearance is large, and hence mismatches between the clearance and the characteristics of the actuator 106 and viscous fluid may occur, making it impossible to obtain an adequate differential thermal expansion absorption performance.

Moreover, with the fuel injection valve 1 of this embodiment, the clearance between the cylinder 3 and piston 7 is sealed by the sealing member 27, and therefore the finishing precision of the cylinder 3 and piston 7 can be reduced, leading to a reduction in manufacturing cost.

Furthermore, since the clearance between the cylinder 3 and piston 7 is not used as a movement passage for the viscous fluid, variation in the cylindricity (circularity) of the cylinder 3 and piston 7, variation (offset) in the concentricity of the cylinder 3 and piston 7, variation (tilting) in the central axis of the cylinder 3 and the central axis of the piston 7, and so on do not affect the differential thermal expansion absorption performance. From these points also, it can be seen that differences among individual products in their differential thermal expansion absorption performance are reduced.

Furthermore, since the clearance between the cylinder 3 and piston 7 is not used as a movement passage for the viscous fluid, dimensional change over time in the cylinder 3 and piston 7 due to sliding and the like does not affect the differential thermal expansion absorption performance. From this point also, it can be seen that differences among individual products in their differential thermal expansion absorption performance are reduced.

Further, the cylinder 3 and piston 7 do not slide via the sealing member 27, and therefore no wear particles are produced. Hence differences in the differential thermal expansion absorption performance accompanying changes in the viscosity of the viscous fluid due to the intrusion of wear particles do not occur.

Further, since the cylinder 3 and piston 7 do not slide via the sealing member 27, malfunctions caused by wear particles, sticking, and so on can also be avoided.

Further, in the fuel injection valve 100 shown in FIG. 7, the outer surface of the piston 105 has to function as a sliding portion and also function to form the movement passage of the viscous fluid, and hence the length (the dimension in the up/down direction) of the piston 105 must be increased to a certain extent. With the fuel injection valve 1 of this embodiment, however, the outer surface of the piston 7 need only function as a sliding portion, and hence the piston 7 can be made comparatively short. Accordingly, the fuel injection valve 1 can be reduced in size and weight.

Further, with the fuel injection valve 1 of this embodiment, the spring 25 pushes the cylinder 3 against the magnetostrictor 9*a* via the seat 23, and hence the cylinder 3 and magnetostrictor 9*a* can maintain an appropriate positional relationship at all times. Even when the length of the magnetostrictor 9*a* decreases due to dimensional change (flattening etc.) over time, for example, the cylinder 3 is caused to move in conjunction with the spring 25 due to the urging force thereof, and can therefore absorb such dimensional change.

Next, another embodiment of the present invention will be described on the basis of FIGS. 3 and 4.

Note that the basic constitution of a fuel injection valve 1' of this embodiment is identical to that of the fuel injection valve 1 shown in FIG. 1. Therefore, identical constitutional elements have been allocated identical reference symbols, and description thereof has been omitted such that only the features of this fuel injection valve 1' are described.

Figure 4:
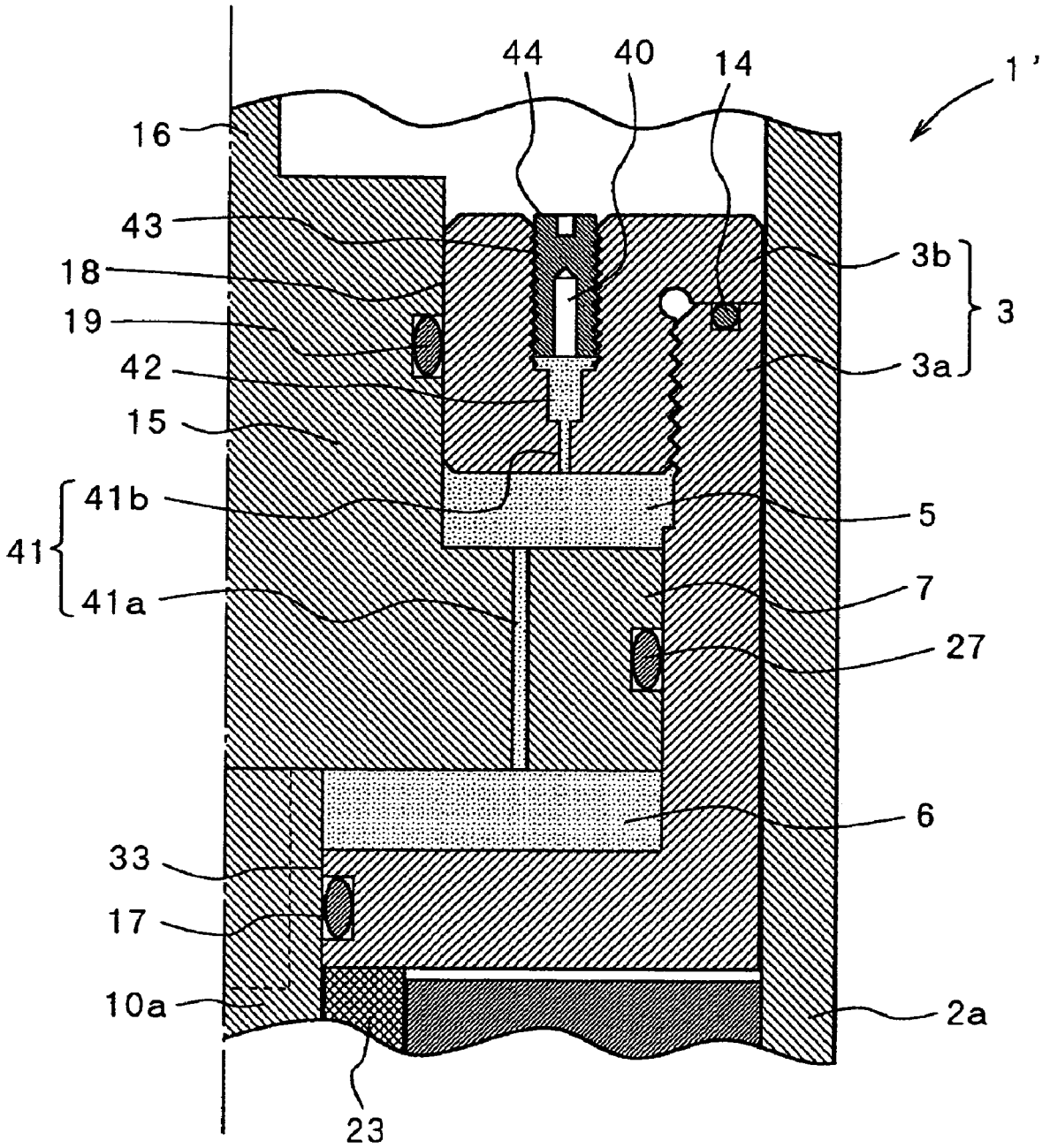
FIG. 4 is a partially enlarged sectional view of FIG. 3.

As shown in FIG. 4, an air chamber 40 is disposed above the upper chamber 5 of the fuel injection valve 1', and this air chamber 40 is connected to the lower chamber 6 via a throttle portion 41. Of the two chambers 5, 6, the lower chamber 6 is the chamber which rises in internal pressure due to compression of the viscous fluid when the cylinder 3 is caused to slide upward. The air chamber 40 accommodates a part of the thermally expanded viscous fluid in the chambers 5, 6 via the throttle portion 41, as will be described below.

To describe the air chamber 40 and throttle portion 41 in more detail, the air chamber 40 is formed within the radial thickness of the cylinder cap 3*b*. On the other hand, the throttle portion 41 is constituted by a first throttle portion 41*a* (pore) formed in the piston 7 to join the lower chamber 6 and upper chamber 5, and a second throttle portion 41*b* (pore) formed in the cylinder cap 3*b* to join the upper chamber 5 to the air chamber 40.

The second throttle portion 41*b* is connected to the air chamber 40 via an intermediate hole 42. More specifically, the second throttle portion 41*b* connected to the upper chamber 5 is formed in the cylinder cap 3*b*, and the intermediate hole 42, having a larger diameter than the second throttle portion 41*b*, is formed in connection with the second throttle portion 41*b*. Further, a screw hole 43 having a larger diameter than the intermediate hole 42 is formed in connection with the intermediate hole 42 so as to open onto the upper face of the cylinder cap 3*b*.

A plug 44 formed with the air chamber 40 on its lower face is screwed into the screw hole 43. Thus the air chamber 40 is connected to the upper chamber 5 via the intermediate hole 42 and the second throttle portion 41*b*. The viscous fluid (shown by dots) in the upper chamber 5 enters a part of the second throttle portion 41*b*, intermediate hole 42, and screw hole 43, but due to gravity, no viscous fluid enters the air chamber 40 positioned thereabove.

As described above, the first throttle portion 41*a* is formed in the piston 7, and hence the lower chamber 6 is connected to the upper chamber 5 via the first throttle portion 41*a*, and to the air chamber 40 via the second throttle portion 41*b*.

In the illustrated example, two each of the first throttle portion 41*a* and second throttle portion 41*b* are formed at 180 degree intervals.

Further, the sealing member 27 is provided between the outer peripheral surface of the piston 7 and the inner peripheral surface of the cylinder main body 3*a* for sealing the gap between the piston 7 and cylinder main body 3*a* in a fluid-tight fashion. Hence the viscous fluid in the upper chamber 5 and the viscous fluid in the lower chamber 6 flow only through the first throttle portion 41*a*.

The flow resistance (dimension/shape) of the first throttle portion 41*a* is set such that at a comparatively low pressure increase speed, which is generated in the upper chamber 5 and lower chamber 6 when the viscous fluid in the chambers 5, 6 thermally expands, the expanded viscous fluid passes through the first throttle portion 41*a*, and at a higher pressure increase speed than the above speed, which is generated in the lower chamber 6 when the cylinder 3 is lifted upward by the actuator 9 (through elongation of the magnetostrictor 9*a*), the viscous fluid in the lower chamber 6 does not pass through the first throttle portion 41*a*. In actuality, the dimension, shape, number, and so on of the first throttle portion 41*a* are determined through appropriate experiments, simulations, and the like based on the driving characteristics (driving speed etc.) of the actuator 9, the characteristics (viscosity etc.) of the viscous fluid, and so on.

The flow resistance of the first throttle portion 41*a* is set to be smaller than the flow resistance of the second throttle portion 41*b*. More specifically, the hole diameter of the first throttle portion 41*a* is greater than the hole diameter of the second throttle portion 41*b*.

To describe the method of introducing the viscous fluid into the cylinder 3, the cylinder main body 3*a* is set vertically, the upper chamber 5 and lower chamber 6 are filled with the viscous fluid, and the cylinder cap 3*b* not having the plug 44 attached to the screw hole 43 is screwed to the cylinder main body 3*a* while the viscous fluid overflows. In so doing, the chance of air bubbles existing in the upper chamber 5 and lower chamber 6 is substantially zero. More viscous fluid is then introduced into the upper chamber 5 through the screw hole 43 such that the interior of the cylinder 3 is completely deaerated. Finally, the plug 44 is screwed into the screw hole 43 and fixed. Thus the assembly of the cylinder 3 and piston 7 is completed.

Next, injection from the fuel injection valve 1' and absorption of differential thermal expansion between members will be described.

Figure 3:
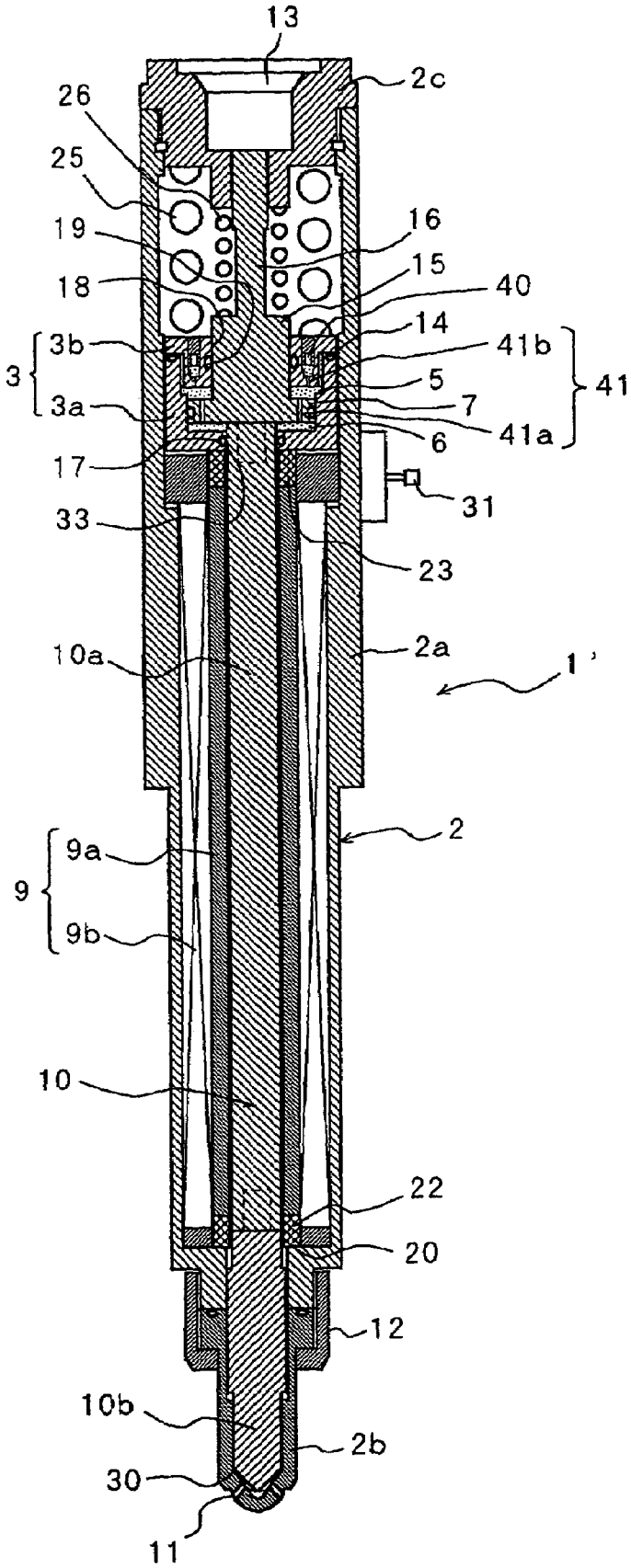
FIG. 3 is a sectional view of a fuel injection valve comprising a differential expansion absorption mechanism according to another embodiment of the present invention.

The fuel that is introduced into the barrel main body 2*a* from the fuel inlet 13 of the cap 2*c* shown in FIG. 3 flows into the seat portion 30 of the tip 2*b* through the gap between the small-diameter rod 16 and cap 2*c*, the gap between the cylinder 3 and barrel main body 2*a*, the gap between the needle valve 10 and magnetostrictor 9*a*, the gap between the needle valve 10 and tip 2*b*, and so on. The pressure of this supplied fuel is set at approximately 100 to 250 Bar, for example.

When the coil 9*b* of the actuator 9 is not energized, the needle valve 10 is urged downward by the spring 26, and hence the lower end portion of the needle valve 10 is pressed against the seat portion 30 of the tip 2*b* with a predetermined pressure such that the injection holes 11 are closed. Accordingly, the fuel does not reach the injection holes 11, and fuel injection is not performed.

On the other hand, when power controlled to a desired value by a controller (ECU or the like), not shown in the drawing, is supplied to the coil 9*b* via the external terminal 31 provided on the barrel main body 2*a*, the coil 9*b* generates a magnetic field of an intensity corresponding to the supplied power.

When the coil 9*b* is magnetized, the magnetostrictor 9*a* elongates in the up/down direction by a length corresponding to the magnetic field intensity. At this time, the lower end of the magnetostrictor 9*a* is in contact with the stepped surface portion 20 of the barrel main body 2*a* via the seat 22, and hence the magnetostrictor 9*a* elongates in such a manner that the cylinder 3 is pushed upward against the urging force of the springs 25, 26. The elongation speed of the magnetostrictor 9*a*, or in other words the speed at which the actuator 9 drives the cylinder 3, is comparatively high (for example, approximately several μm/μs).

As described above, in this case the pressure increase speed inside the lower chamber 6 reaches a predetermined value or more, and thus the viscous fluid in the lower chamber 6 functions as a solid without passing through the first throttle portion 41*a*. Hence when the cylinder 3 is pushed upward by the magnetostrictor 9*a*, the piston 7 and needle valve 10 are raised (lifted) integrally via the viscous fluid in the lower chamber 6, and the springs 25, 26 are deformed. As a result, the lower end of the needle valve 10 separates from the seat portion 30 of the tip 2*b* such that the injection holes 11 are opened, whereupon the high-pressure fuel supplied up to the seat portion 30 is injected outside (into the combustion chamber) from the injection holes 11 as a spray.

Further, when differential thermal expansion occurs between members, for example when the thermal expansion of the magnetostrictor 9*a* is greater than the thermal expansion of the needle valve 10, a force causing the cylinder 3 to be lifted by the thermal expansion of the magnetostrictor 9*a* is generated, and the internal pressure of the lower chamber 6 rises slowly (at an equal or lower speed than the pressure increase speed generated by the actuator 9). At this time, the viscous fluid in the lower chamber 6 flows into the upper chamber 5 through the first throttle portion 41*a* such that the position of the piston 7 does not shift and only the cylinder 3 is lifted. As a result, the needle valve 10 connected to the piston 7 is not lifted by the differential thermal expansion between the magnetostrictor 9*a* and needle valve 10.

An operation of the fuel injection valve 1' according to this embodiment will now be described.

When the entire fuel injection valve 1' is heated by heat from the cylinder head or the like, for example, the cylinder 3 and the viscous fluid in the interior thereof are heated to a substantially identical temperature. Since the viscous fluid (silicone oil or the like) has a greater thermal expansion coefficient than the cylinder 3 (iron-type metal) by up to approximately two figures, the volume of the viscous fluid cannot be accommodated by the volume of the upper chamber 5 and lower chamber 6, and hence the internal pressure of the upper chamber 5 and lower chamber 6 rises gradually.

Here, the upper chamber 5 and lower chamber 6 are joined by the first throttle portion 41*a*, which has a larger diameter than the second throttle portion 41*b*, and hence the viscous fluid in the upper chamber 5 and lower chamber 6 thermally expands substantially integrally, causing the internal pressure of the upper chamber 5 and lower chamber 6 to rise gradually. When the internal pressure of the upper chamber 5 and lower chamber 6 increases at such a comparatively low speed, a part of the expanded viscous fluid flows into the air chamber 40 through the second throttle portion 41*b*, as described above. As a result, the internal pressure of the upper chamber 5 and lower chamber 6 falls, and hence damage to the seals 17, 19 and plug 44 caused by thermal expansion of the viscous fluid can be avoided.

On the other hand, when the cylinder 3 is lifted by the magnetostrictor 9*a* in order to open the needle valve 10, the pressure of the viscous fluid in the lower chamber 6 rises quickly at a higher speed than the aforementioned pressure increase speed generated by the thermal expansion of the viscous fluid. Hence the viscous fluid in the lower chamber 6 does not pass through the first throttle portion 41*a*, and the piston 7 is lifted integrally with the cylinder 3, as described above. As a result, there is almost no increase in the pressure in the upper chamber 5 at this time, and the viscous fluid in the upper chamber 5 does not flow into the air chamber 40 through the second throttle portion 41*b*.

Incidentally, when a difference arises in the internal pressure of the upper chamber 5 and lower chamber 6 during thermal expansion of the viscous fluid, the viscous fluid in the upper chamber 5 and lower chamber 6 flows through the first throttle portion 41*a* so as to balance the internal pressure difference between the upper chamber 5 and lower chamber 6, and substantially simultaneously, the viscous fluid flows into the air chamber 40 through the second throttle portion 41*b*. Here, the first throttle portion 41*a* has a larger diameter than the second throttle portion 41*b*, and hence the viscous fluid flows more easily therethrough, leading to an increased flow rate. Accordingly, balancing the internal pressure difference by passing through the first throttle portion 41*a* takes precedence over thermal expansion absorption by passing through the second throttle portion 41*b*. As a result, situations in which the needle valve 10 is lifted or lowered (pressed excessively against the seat portion 30) due to this internal pressure difference can be avoided.

Further, when the cylinder 3 and piston 7 are assembled, the viscous fluid is charged through the screw hole 43 into the upper chamber 5 and lower chamber 6 with no air bubbles, and the plug 44 is screwed into the screw hole 43 to seal in the viscous fluid. As a result, the viscous fluid in the upper chamber 5 and lower chamber 6 is sealed via the air inside the air chamber 40 of the plug 44, and the pressure of the viscous fluid in the upper chamber 5 and lower chamber 6 can be managed to substantially constant levels in individual products (cylinder/piston assemblies).

To explain this point, in the fuel injection valve 100 shown in FIG. 7 and described in the related art section, the viscous fluid (incompressible) is charged into the cylinder 102, and the injection passage is blocked by a plug. Hence when an attempt is made to completely deaerate the interior of the cylinder 102 and then block it, this must be performed with an internal pressure existing in the interior of the cylinder 102. In the step of attaching the plug to the injection passage, this internal pressure differs among individual products (piston/cylinder assemblies) due to variation in the sealing start point of the internal pressure at which the viscous fluid can be sealed in by the plug. As a result, irregularities occur in the overflow limit temperature of the viscous fluid due to differential thermal expansion between the viscous fluid and cylinder 102.

In this embodiment, on the other hand, the viscous fluid is sealed in via the air in the air chamber 40, and hence variation in the internal pressure of the cylinder 3 among individual products is absorbed by compressing the air in the air chamber 40 appropriately such that the internal pressure of the viscous fluid is substantially constant among individual products. As a result, management of the overflow limit temperature is facilitated. Note that when the cylinder 3 is lifted by the actuator 9 as described above, the air in the air chamber 40 does not affect lifting of the piston 7 and needle valve 10.

Figure 5:
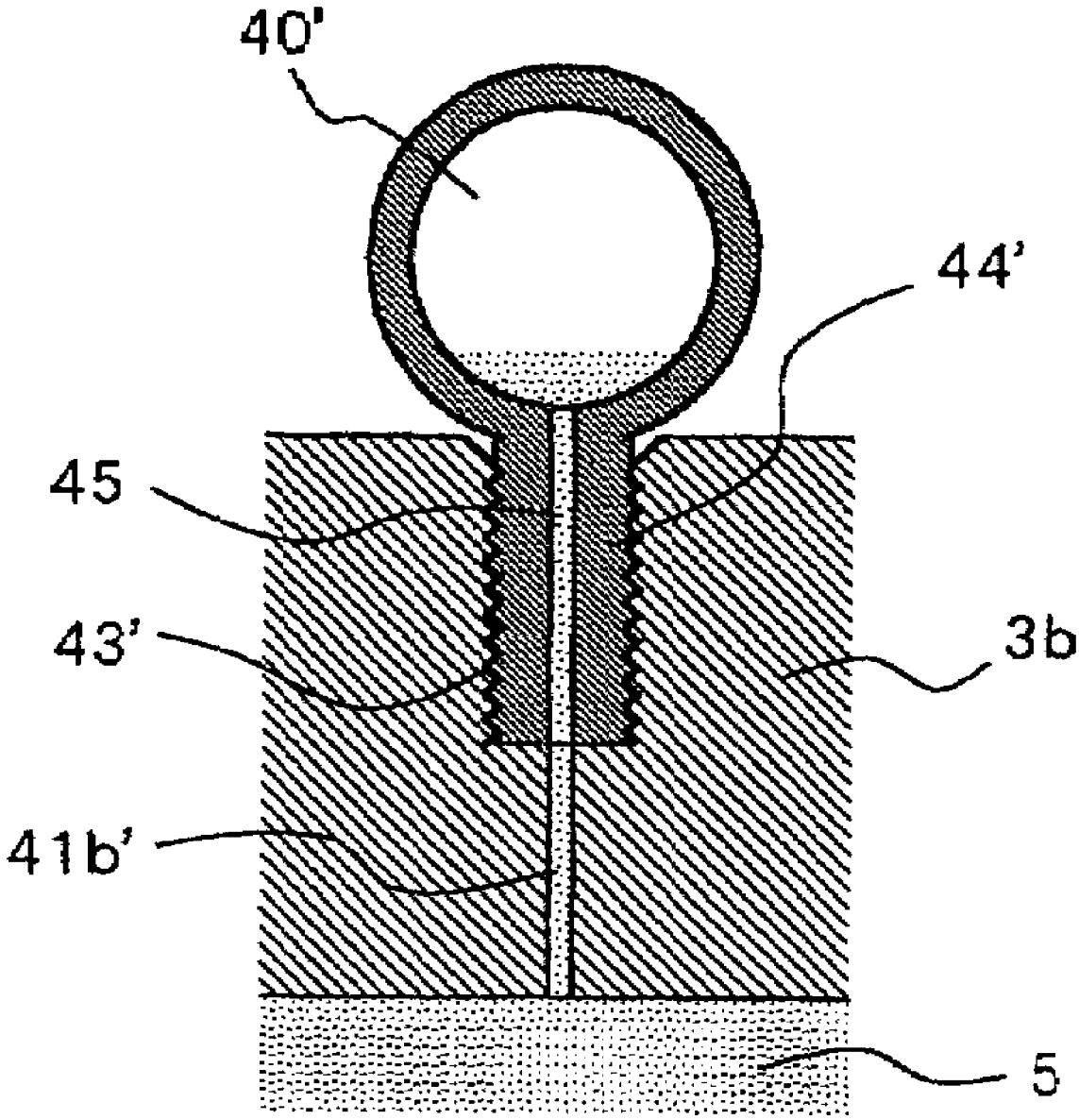
FIG. 5 is a sectional view showing a modified example of a throttle portion and an air chamber.

A modified example of the air chamber 40 and second throttle portion 41*b* is shown in FIG. 5.

In this modified example, a pore is formed in the cylinder cap 3*b* as a second throttle portion 41*b*', a screw hole 43' is formed at the upper portion of the second throttle portion 41*b*', and a plug 44' formed with a pore 45 and an air chamber 40' which connect to the second throttle portion 41*b*' is screwed into the screw hole 43'. A part of the viscous fluid in the upper chamber 5 enters a part of the second throttle portion 41*b*', pore 45, and air chamber 40'. The other constitutions of this modified example are identical to those of the embodiments described above, and hence similar actions and effects to those of the embodiments described above are exhibited.

Figure 6:
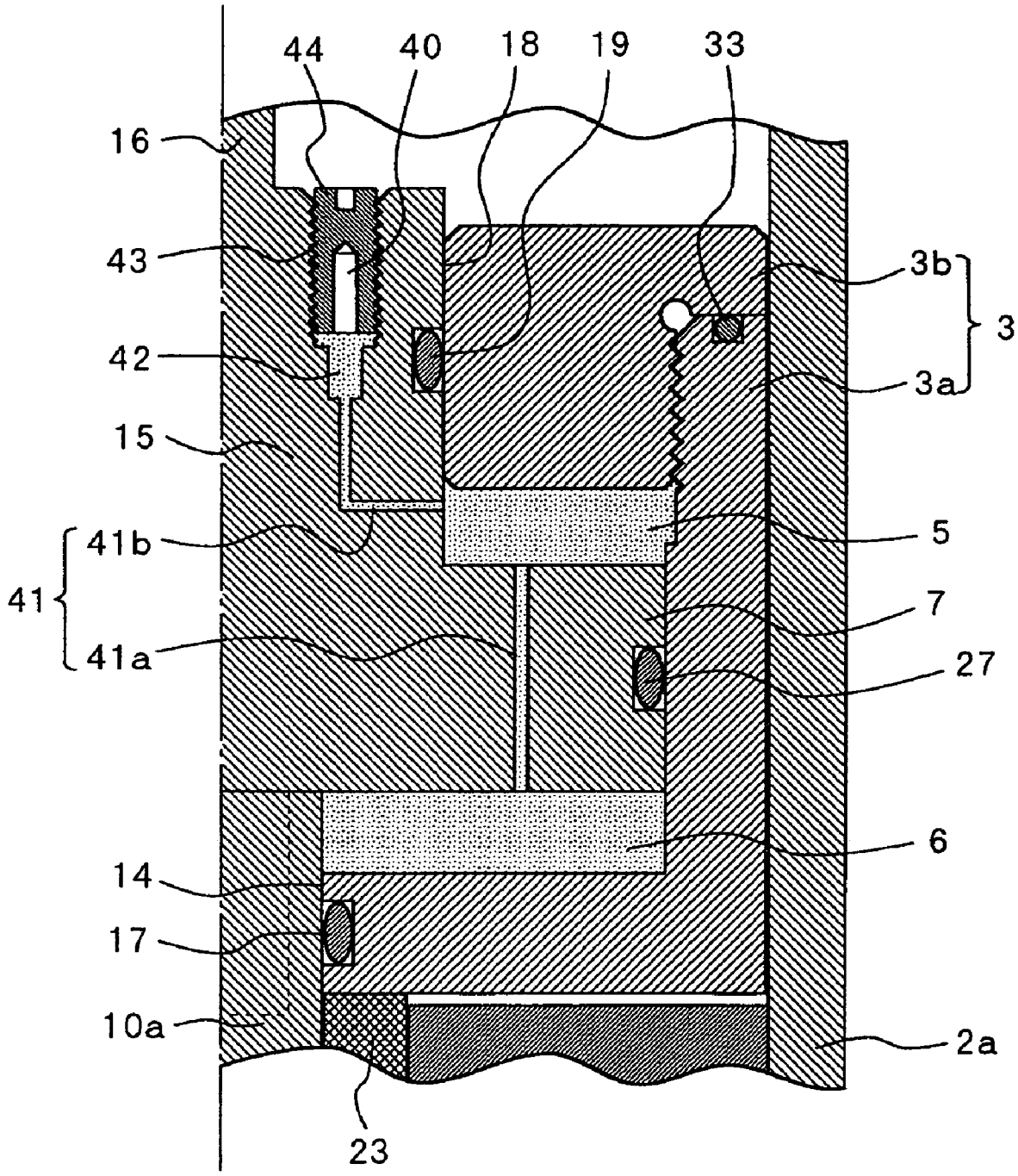
FIG. 6 is a partially enlarged sectional view showing another modified example.

Another modified example is shown in FIG. 6.

This modified example differs from the embodiment shown in FIG. 4 only in that the second throttle portion 41*b*, intermediate hole 42, screw hole 43, and plug 44 of the embodiment shown in FIG. 4 are formed in the large-diameter rod 15 of the piston 7 rather than the cylinder cap 3*b*. Similar actions and effects to those of the embodiments described above are also exhibited by this modified example.

Here, the second throttle portion 41*b* and air chamber 40 shown in FIGS. 4 to 6 may be connected to the lower chamber 6 rather than the upper chamber 5, or may be connected to both the upper chamber 5 and lower chamber 6.

When the second throttle portion 41*b* and air chamber 40 are connected directly to the lower chamber 6 (the chamber 6 on the side which rises in internal pressure when the actuator 9 causes the cylinder 3 to slide upward) in this manner, the flow resistance (dimensions, shape etc.) of the second throttle portion 41*b* may be set equally to the flow resistance of the first throttle portion 41*a* shown in FIGS. 4 and 6. As a result, similar actions and effects to those of the embodiments shown in FIGS. 4 and 6 are exhibited.

Further, the number of the first throttle portion 4*a* and second throttle portion 41*b* is not limited to two, and one, three, or more may be provided. The present invention may also be applied to a fuel injection valve in which the first throttle portion 41*a* is not formed in the piston 105 shown in FIG. 7. In this case, the clearance between the piston 105 and cylinder 102 corresponds to the first throttle portion 41*a*. More specifically, the first throttle portion 41*a* and sealing member 27 formed in the piston 7 shown in FIGS. 3, 4, and 6 may be omitted, a predetermined clearance may be set between the piston 7 and cylinder 3, and this clearance may serve as the first throttle portion 41*a*.

Note that the plurality of embodiments described above are merely examples, and are not intended to limit the present invention.

For example, the actuator 9 is not limited to an actuator which uses the magnetostrictor 9*a*, and an electrostrictor or the like which elongates in accordance with supplied power may be used instead. Further, the sealing members 14, 17, 18, 19, 27 are not limited to O-rings, and other sealing members may be used. Also, the first urging means 25 and second urging means 26 are not limited to coil springs, and other urging means such as plate springs may be used.

Further, in the embodiments described above, examples applied to a fuel injection valve for injecting a gaseous fuel were illustrated, but it goes without saying that the present invention may also be applied to a fuel injection valve or the like for injecting gasoline. Moreover, the differential expansion absorption mechanism described above may be used to absorb differential thermal expansion in a mechanism other than a fuel injection valve.

What is claimed is:

1. A differential expansion absorption mechanism having a cylinder accommodated slidably inside a casing, a piston for partitioning the interior of the cylinder into two chambers, and a viscous fluid charged into the two chambers respectively, the differential expansion absorption mechanism serving to move the piston through the viscous fluid by causing the cylinder to slide, wherein an air chamber is connected via a throttle portion to at least one of the two chambers which rises in internal pressure when the cylinder or the piston is caused to slide, a flow resistance of the throttle portion being set such that at a predetermined pressure increase speed or higher, which predetermined pressure increase speed is generated in the chamber when the cylinder or the piston is caused to slide, the viscous fluid does not pass through the throttle portion, and at a lower pressure increase speed than the predetermined pressure increase speed, which lower pressure increase speed is generated in the chamber when the viscous fluid thermally expands, the expanded viscous fluid passes through the throttle portion.

2. A fuel injection valve comprising a differential expansion absorption mechanism, having a cylinder accommodated slidably inside a barrel, a piston for partitioning the interior of the cylinder into two chambers, a viscous fluid charged into the two chambers respectively, an actuator for causing the cylinder to slide, and a needle valve connected to the piston, the fuel injection valve serving to lift the needle valve via the viscous fluid and the piston by having the actuator cause the cylinder to slide, wherein an air chamber is connected via a throttle portion to at least one of the two chambers which rises in internal pressure when the cylinder is caused to slide by the actuator, a flow resistance of the throttle portion being set such that at a pressure increase speed which is generated in the at least one chamber when the cylinder is caused to slide by the actuator, the viscous fluid does not pass through the throttle portion, and at a lower pressure increase speed than the pressure increase speed, which lower pressure increase speed is generated in the at least one chamber when the viscous fluid thermally expands, the expanded viscous fluid passes through the throttle portion.

3. The fuel injection valve comprising a differential expansion absorption mechanism according to claim 2, wherein the actuator causes the cylinder to slide upward, the piston partitions the interior of the cylinder vertically into an upper chamber and a lower chamber, the air chamber is disposed above the upper chamber, and the throttle portion comprises a first throttle portion linking the lower chamber and the upper chamber, and a second throttle portion linking the upper chamber and the air chamber, a flow resistance of the first throttle portion being set such that at a pressure increase speed which is generated in the lower chamber when the cylinder is caused to slide by the actuator, the viscous fluid does not pass through the first throttle portion, and at a lower pressure increase speed than the pressure increase speed, which lower pressure increase speed is generated in each of the chambers when the viscous fluid thermally expands, the expanded viscous fluid passes through the first throttle portion.

4. The fuel injection valve comprising a differential expansion absorption mechanism according to claim 3, wherein the flow resistance of the first throttle portion is set lower than a flow resistance of the second throttle portion.

5. The fuel injection valve comprising a differential expansion absorption mechanism according to claim 2, wherein the throttle portion and the air chamber are provided in the interior of the cylinder and/or the piston.

6. The fuel injection valve comprising a differential expansion absorption mechanism according to claim 2, wherein the actuator comprises a magnetostrictor or an electrostrictor.

7. The fuel injection valve comprising a differential expansion absorption mechanism according to claim 2, comprising:

first urging means for urging the cylinder in a direction in which the cylinder is pressed against the actuator; and second urging means for urging the needle valve in a valve dosing direction.

* * * * *

UNITED STATES PATENT AND TRADEMARK OFFICE

CERTIFICATE OF CORRECTION

PATENT NO. : 7,198,202 B2
APPLICATION NO. : 11/104747
DATED : April 3, 2007
INVENTOR(S) : Masaki Okada It is certified that error appears in the above-identified patent and that said Letters Patent is hereby corrected as shown below:

Column 18, Claim 7, Line 55, please delete the word "dosing" and replace with --closing--.

Signed and Sealed this

Fifth Day of June, 2007

JON W. DUDAS
*Director of the United States Patent and Trademark Office*